US009505147B2

(12) United States Patent
Jones

(10) Patent No.: US 9,505,147 B2
(45) Date of Patent: Nov. 29, 2016

(54) CUTTING PLATFORM AND METHOD OF USING THE SAME

(71) Applicant: TRIUMPH INGENUITY LLC, Twinsburg, OH (US)

(72) Inventor: Steven T. Jones, Twinsburg, OH (US)

(73) Assignee: Triumph Ingenuity LLC, Twinsburg, OH (US)

( * ) Notice: Subject to any disclaimer, the term of this patent is extended or adjusted under 35 U.S.C. 154(b) by 66 days.

(21) Appl. No.: 14/482,463

(22) Filed: Sep. 10, 2014

(65) Prior Publication Data

US 2016/0067886 A1 Mar. 10, 2016

(51) Int. Cl.
*B28D 1/04* (2006.01)
*B28D 7/00* (2006.01)

(52) U.S. Cl.
CPC ..... *B28D 1/045* (2013.01); *B28D 7/00* (2013.01)

(58) Field of Classification Search
CPC ..... B28D 1/04; B28D 1/042
USPC ..... 125/35, 13.01, 4; 451/439
See application file for complete search history.

(56) References Cited

U.S. PATENT DOCUMENTS 1,580,155 A * 4/1926 Niestradt ..... B28D 1/18 125/4
2,014,229 A * 9/1935 Emmons ..... B23D 59/02 125/13.01
2,464,117 A * 3/1949 Coates ..... B28D 7/043 125/13.01
4,614,063 A * 9/1986 Crivaro ..... B24B 7/186 451/350
6,203,112 B1 * 3/2001 Cook ..... E01C 23/0933 125/13.01

* cited by examiner

*Primary Examiner* — Robert Rose
(74) *Attorney, Agent, or Firm* — Sand & Sebolt

(57) ABSTRACT

A cutting platform for supporting a cutter adjacent a concrete pad and a method of making clean cuts into the pad is disclosed. The platform includes a base having an upper surface positioned so that it is level with an upper surface of the pad. The cutter is received on the base's upper surface and is rollable onto the pad's upper surface. One or more support legs extend downwardly from a lower surface of the base and are adjustable in length. At least one arm extends outwardly from the base and rests on the pad's upper surface. A replaceable insert is received in a recess in the first end of the base adjacent the pad. The cutter's blade is actuated and cuts initially into the insert. As the cutter rolls from the base onto the pad, a clean cut is made into the side and upper surface of the pad.

25 Claims, 10 Drawing Sheets

CUTTING PLATFORM AND METHOD OF USING THE SAME

BACKGROUND OF THE INVENTION

Technical Field

This invention relates generally to construction equipment. More particularly, the invention is directed to equipment used during cutting of expansion joints into concrete. Specifically, the invention is directed to a cutting platform used to support a concrete cutter, particularly during the initial stages of cutting an expansion joint into a concrete pad such as a pad that forms a deck for an inground swimming pool.

Background Information

Concrete pads need to have expansion joints cut into them in order to allow for expansion and contraction of the concrete. In certain settings, such as in concrete pads for patios and pool decks, the pads extend for a distance above the ground surface that surrounds the pad. In order to cut these expansion joints into such a raised pad, a concrete cutter is typically rolled across the surface of the pad. A rotating saw blade on the concrete cutter bites into the concrete pad and denudes the concrete to form the joint.

The most problematic area of this joint-cutting process is the making of the initial cut into the pad. Much like cutting wood, it is ideal for the blade to be rotating when it makes the initial cut into the concrete pad. If the blade rotation is initiated when the concrete cutter is already on the pad, considerable damage to the upper surface of the pad may occur. It is particularly desirable to start cutting into the concrete pad at the outermost edge thereof. However, concrete cutters are decently heavy and unwieldy machines and positioning them a height above the ground at an edge of the concrete pad and with the blade rotating is very difficult. A movement in the wrong direction may result in considerable damage to the concrete pad and/or injury to the user of the concrete cutter.

SUMMARY

The apparatus and method disclosed herein is presented as providing a possible solution to the aforementioned problems in the art.

A cutting platform for supporting a concrete cutter adjacent a concrete pad and a method of making clean cuts into the pad is disclosed. The platform includes a base having an upper surface positioned so that it is level with an upper surface of the concrete pad. The cutter is received on the base's upper surface and is rollable onto the pad's upper surface. One or more support legs extend downwardly from a lower surface of the base and are adjustable in length. At least one arm extends outwardly from the base and rests on the pad's upper surface. A replaceable insert is received in a recess in the first end of the base adjacent the pad. The cutter's blade is actuated and cuts initially into the insert. As the cutter rolls from the base and onto the pad, a clean cut is made into side and upper surface of the pad.

In one aspect, the invention may provide a cutting platform for supporting a concrete cutter adjacent a concrete pad; said cutting platform comprising a base adapted to receive the concrete cutter on an upper surface thereof; at least a first support leg extending downwardly and outwardly from a lower surface of the base; and at least one arm provided on the base, at least part of the at least one arm extending outwardly and forwardly from a first end of the base and being adapted to rest on an upper surface of the concrete pad.

In other aspect, the invention may provide a cutting platform having a base in which a recessed region is defined in the first end thereof; and wherein the cutting platform further includes an insert that is complementary to the recessed region and is selectively receivable therein. The insert may be comprised of wood or a material that is cuttable by a saw blade of a concrete cutter.

In another aspect, the invention may provide a method of cutting an elevated concrete pad comprising positioning a cutting platform adjacent a side wall of the concrete pad; adjusting the height of the cutting platform so that an upper surface of the cutting platform is substantially horizontally aligned with an upper surface of the concrete pad; positioning a concrete cutter on the upper surface of the cutting platform so that a saw blade on the concrete cutter is disposed adjacent a region of the upper surface of the cutting platform; actuating the concrete cutter so that the saw blade rotates and begins to cut into the region of the upper surface of the cutting platform; advancing the concrete cutter with the rotating blade across the upper surface of the cutting platform and toward the side wall of the concrete pad; cutting into an upper edge of the side wall of the concrete pad with the rotating saw blade; advancing the concrete cutter with the rotating saw blade from the upper surface of the cutting platform and onto the upper surface of the concrete pad; and cutting into the upper surface of the concrete pad with the rotating saw blade.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Referring to FIGS. 1-10, there is shown a cutting platform in accordance with an aspect of the invention, generally indicated at 10. Platform 10 is shown positioned adjacent a concrete pad 12. Pad 12 has a top surface 12*a* and a side surface 12*b* which are illustrated as being oriented at right angles to each other. Pad 12 is of a height "H" (FIG. 5) above a ground surface 44 which surrounds pad 12. It can be seen from FIG. 1, that top surface 12*a* of platform 10 is substantially free of any expansion joints or other cuts. Platform 10 is shown positioned so that at least a portion of first end 16*e* thereof is in abutting contact with side surface 12*b* of pad 12. Platform 10 is ready to support a concrete cutter 14 (FIG. 6) in a position where cutter 14 is able to be moved onto concrete pad 12 in order to cut an expansion joint therein, as will be later described herein.

Figure 2:
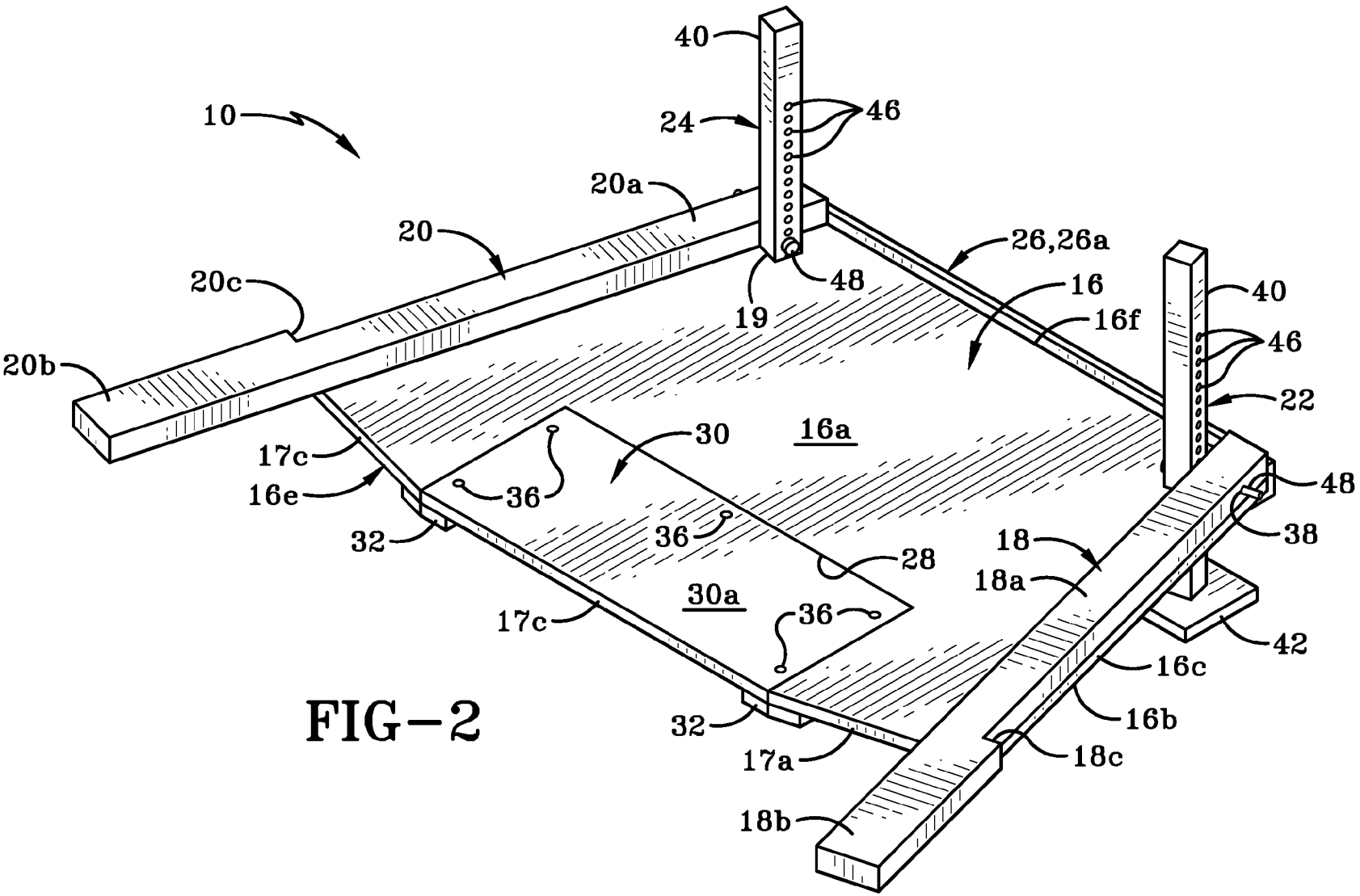
FIG. 2 is a front perspective view of the cutting platform.
Figure 3:
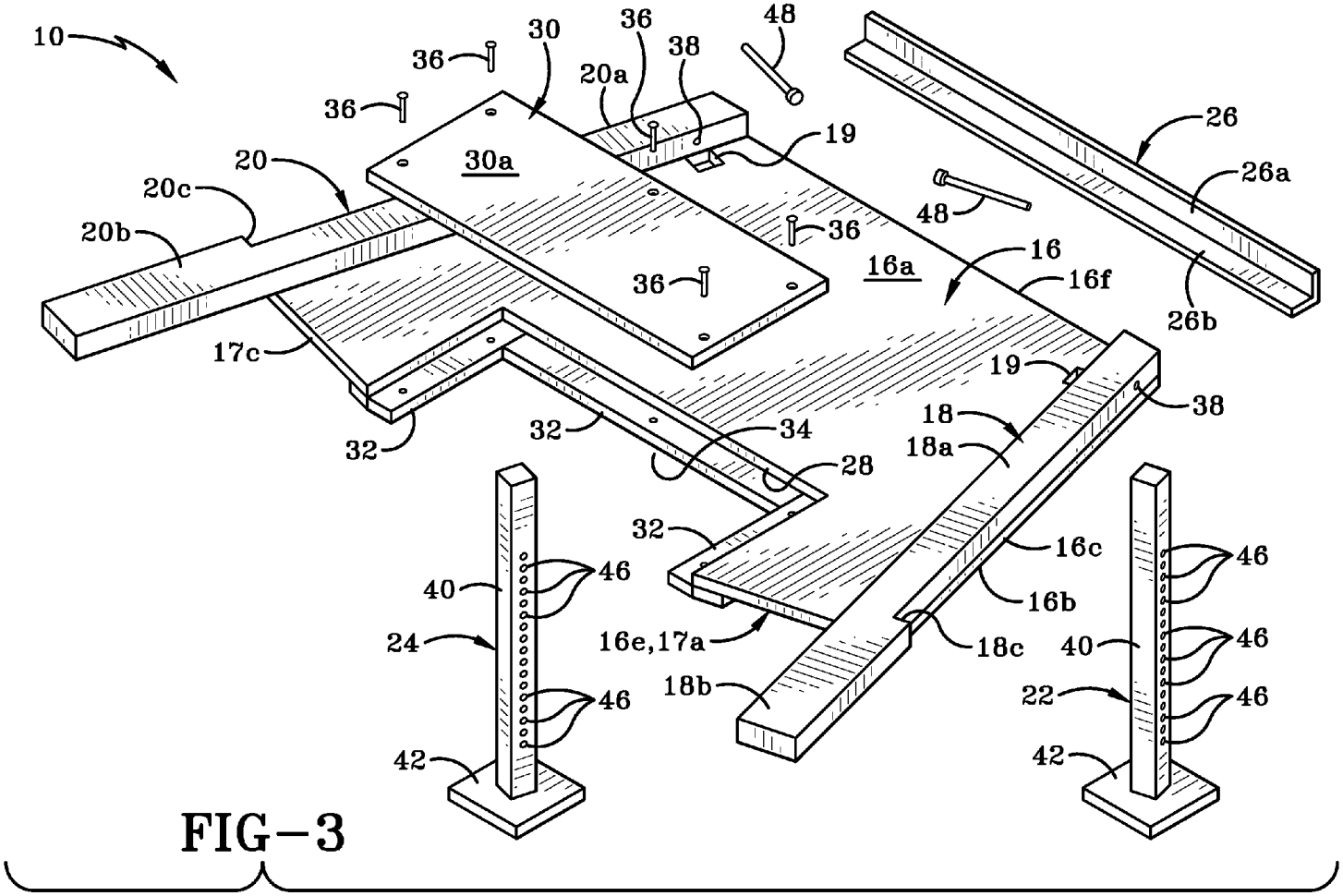
FIG. 3 is an exploded front perspective view of the platform.

Platform 10 is shown in greater detail in FIGS. 2 and 3. Platform 10 includes a base 16, a first arm 18, a second arm 20, a first support leg 22, a second support leg 24, and a stop 26. Base 16 has an upper surface 16*a*, a lower surface 16*b*, a first side 16*c*, a second side 16*d*, a first end 16*e*, and a second end 16*f*. First and second support legs 22, 24 are located adjacent second end 16*f* of base 16. Furthermore, first support leg 22 is located adjacent first side 16*c*; and second support leg 24 is located adjacent second side 16*d*.

Figure 4:
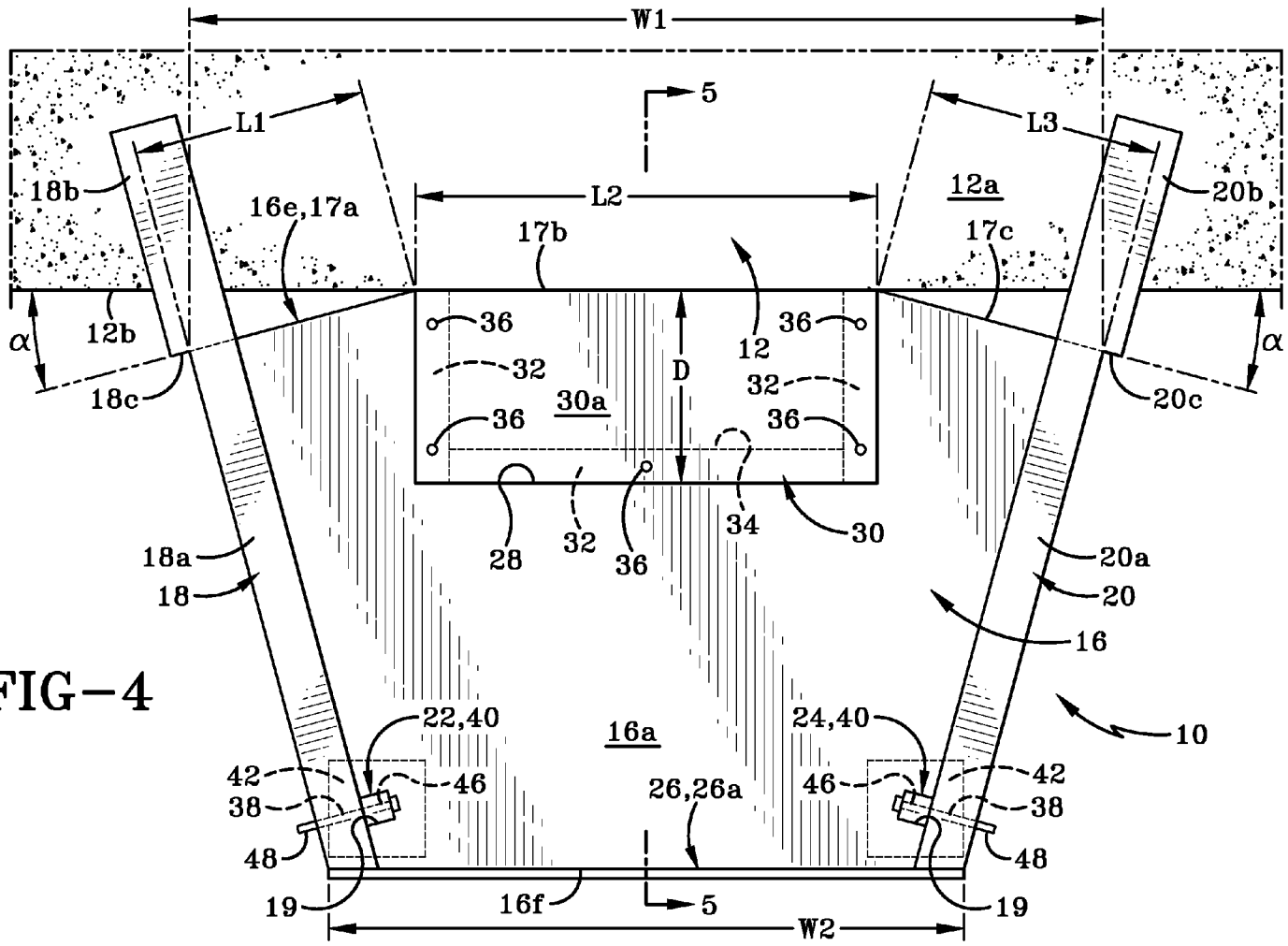
FIG. 4 is a top view of the platform.

As shown in FIG. 4, first end 16*e* of base is of a first width "W1" and second end 16*f* is of a second width "W2". First width "W1" is greater than second width "W2" and, consequently, platform 10 tapers from first end 16*e* to second end 16*f*. First end 16*e* may be comprised of more than one section, such as the three sections, 17*a*, 17*b*, and 17*c* illustrated herein. Second section 17*b* is straight along its outer edge which forms part of first end 16*e*. Second section 17*b* is shown as abutting side surface 12*b* of concrete pad 12. First section 17*a* and third section 17*c* are each disposed at an angle $\alpha$ relative to second section 17*b*. First section 17*a* and third section 17*c* extend outwardly and rearwardly away from opposite ends of second section 17*b* and in opposite directions relative to each other. First and third sections 17*a*, 17*c* also flare away from each other. Each of the first, second, and third sections 17*a*, 17*b*, 17*c* are straight along their outer edges which form part of first end 16*e*. First section 17*a* is of a length "L1", second section 17*b* is of a length "L2", and third section 17*c* is of a length "L3". Lengths "L1" and "L3" of first and third sections 17*a*, 17*c* are substantially equal in size. Length "L2" is about twice as long as either of lengths "L1" and "L3".

Figure 1:
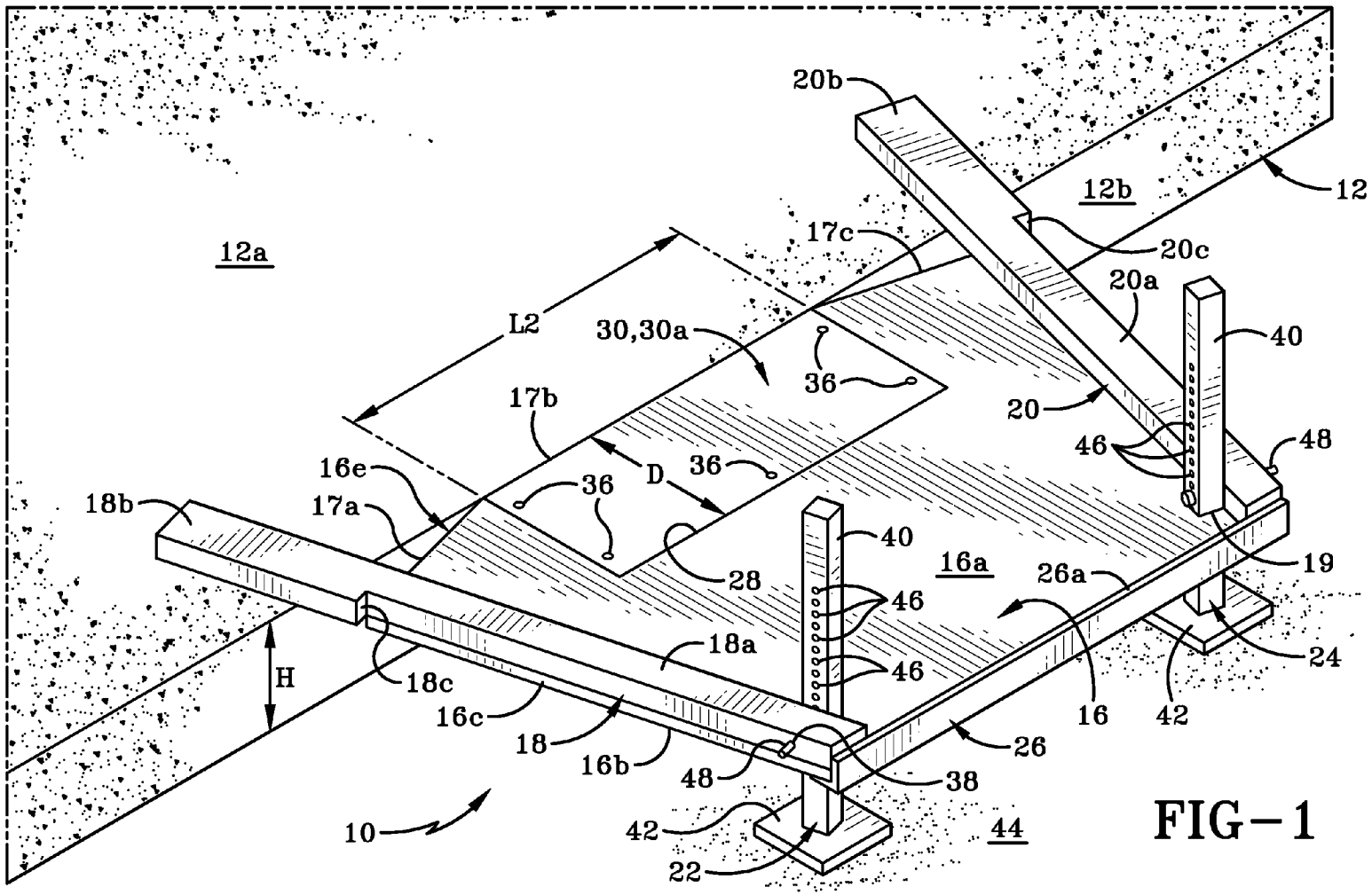
FIG. 1 is a rear perspective view of a cutting platform positioned adjacent a concrete pad.

Base 16 may include a generally U-shaped recess 28 (FIG. 3) into which a complementary insert 30 is received. Insert 30 may be a generally rectangular member that has a length "L2" and a depth "D" (FIG. 1). A strip 32 is secured to bottom surface 16*b* of base 16. Strip 32 is generally U-shaped and defines a second U-shaped recess 34 (FIGS. 3 and 4) that is of smaller dimensions than U-shaped recess 28 and thereby forms a lip that extends outwardly into recess 28. Insert 30 is secured to this lip formed by strip 32 by way of a plurality of fasteners 36.

Insert 30 may be fabricated from a material such as wood or some other material that is readily cuttable by a saw blade 15 of a concrete cutter 14. The rest of cutting platform 10 may be fabricated from wood but it may alternatively be fabricated from a more durable material such as metal. Insert 30 is selectively removable and is able to be replaced with another identically shaped insert when blade 15 of concrete cutter 14 has made too many cuts into insert 30, as will be later described herein. As is evident from the figures, one of the outer side edges of insert 30 forms second section 17*b* of first end 16*e* of platform 16. (It will be understood that, alternatively, recess 28 and insert 30 may be omitted completely and base 16 may instead be a single unitary piece of sheet material that extends from first end 16*e* to second end 16*f*.)

A pair of apertures 19 (FIG. 3) is defined in base 16. Each aperture 19 extends from upper surface 16*a* through to lower surface 16*b* of base 16. One of apertures 19 is located proximate the intersection of first side 16*c* and second end 16*f* of base 16. The other of the pair of apertures 19 is located proximate the intersection of second side 16*d* and second end 16*f* of base. The purpose of apertures 19 will be discussed later herein.

Figure 5:
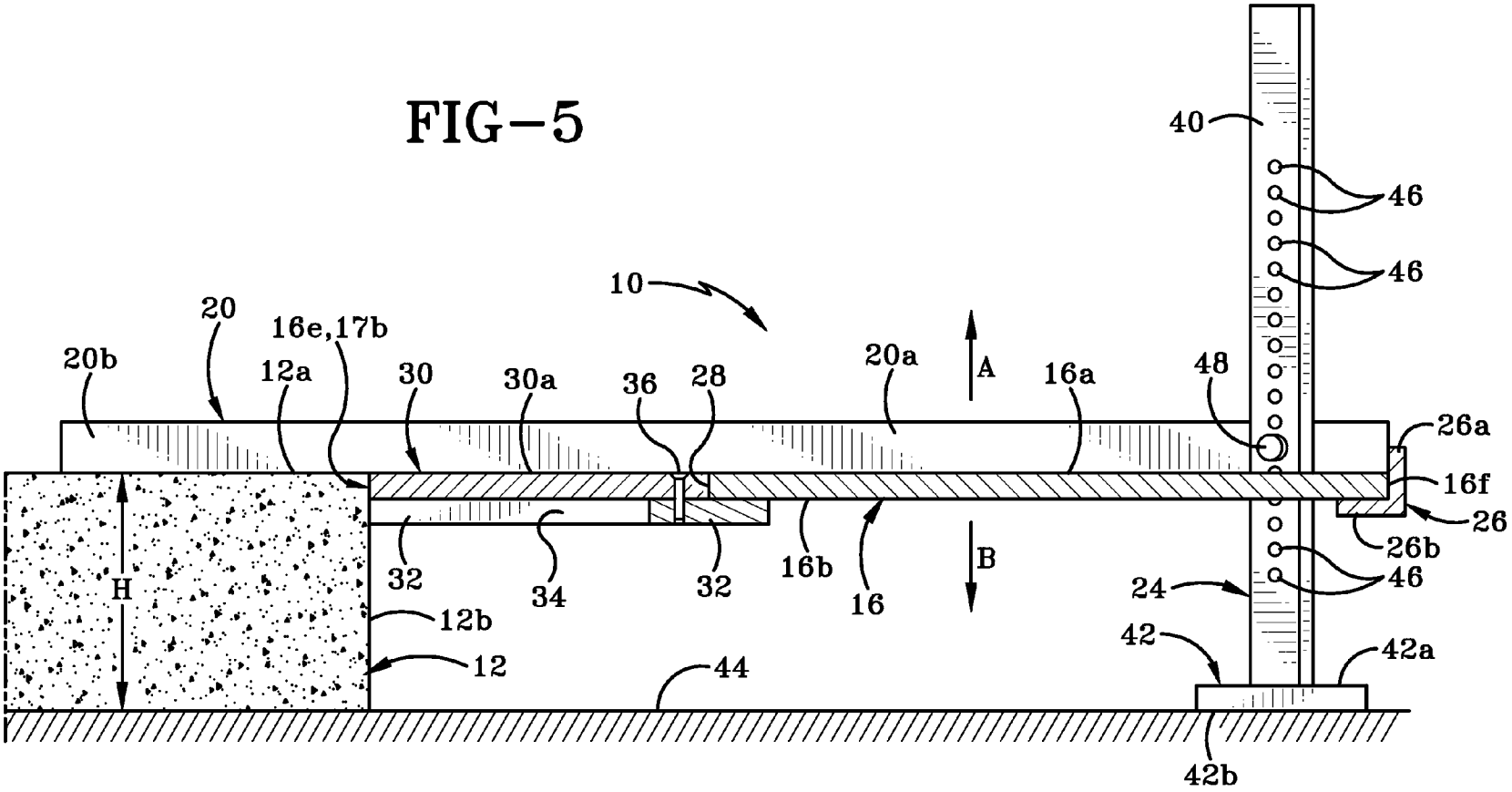
FIG. 5 is a cross-sectional view of the cutting platform taken along line 5-5 of FIG. 4.

First arm 18 and second arm 20 extend outwardly and forwardly away from first end 16*e* of base and are provided to rest on upper surface 12*a* of concrete pad 12 as shown in FIGS. 1, 4 and 5. First and second arms 18, 20 support first end 16*e* of base 16 a distance "H" above ground surface 44 and thus retains upper surface 16*a* of base 16 at the same height as upper surface 12*a* of concrete pad 12.

First and second arms 18, 20 are substantially identically shaped but are provided on upper surface 16*a* of platform 16 in such a way that the arms 18, 20 are arranged as mirror images of each other. Each of first and second arms 18, 20 includes an elongate first section 18*a*, 20*a* of a smaller width, and a shorter and wider second section 18*b*, 20*b*. First sections 18*a*, 20*a* are positioned on upper surface 16*a* of base 16 and extend upwardly for a distance therefrom. Thus, the first sections 18*a*, 20*a* of first and second arms 18, 20 create a small lip along each of the first and second sides 16*c*, 16*d* of base. First sections 18*a*, 20*a* are substantially equal in length to the respective first and second sides 16*c*, 16*d* of base 16. First sections 18*a*, 20*a* may be secured in a suitable manner to upper surface 16*a* of base 16 and along first and second sides 16*c*, 16*d* or they may be integrally formed therewith. A shoulder 18*c*, 20*c* (FIG. 4) is formed where each second section 18*b*, 20*b* extends outwardly from the associated first section 18*a*, 20*a*. Shoulders 18*c*, 20*c* are generally aligned with first end 16*e* of base 16, specifically with regions of first and third sections 17*a*, 17*c* thereof, respectively. Second sections 18*b*, 20*b* extend for a distance outwardly and forwardly beyond first end 16*e* of base 16 16 and are adapted to rest upon upper surface 12*a* of concrete pad 12. The positioning of second sections 18*b*, 20*b* is such that upper surface 16*a* of base 16 is substantially horizontally aligned with upper surface 12*a* of concrete pad 12. It should be noted that apertures 19 are defined in base 16 in a position adjacent the interior surfaces of each of the respective first sections 18*a*, 20*a*.

A hole 38 (FIG. 3) is defined in each of the first sections 18*a*, 20*a* proximate a rear end of each of the first and second arms 18, 20. These rear ends of first and second arms 18, 20 are substantially aligned with second end 16*f* of base 16. Each hole 38 extends from an interior surface of the selected one of the first and second arms 18, 20 to an exterior surface thereof. The purpose of hole 38 will be further described herein.

First and second legs 22, 24 are substantially identical in shape and include a vertical member 40 and a horizontal member 42. As shown in FIG. 5, horizontal member 42 has an upper surface 42*a* and a lower surface 42*b*. Lower surface 42*b* is adapted to rest upon ground surface 44 which surrounds pad 12. The horizontal members 42 are positioned a lateral distance away from side surface 12*b* of pad 12. Each vertical member 40 extends upwardly and outwardly away from upper surface 42*a* of the associated horizontal member 42. Vertical member 40 may be disposed generally at right angles to horizontal member 42. As best seen in FIG. 4, vertical member 40 is positioned generally centrally on horizontal member 42. Vertical member 40 is sized and shaped to be complementary to the cross-sectional shape of one of the apertures 19 and a portion of each vertical member 40 extends through one of the apertures 19. As illustrated herein, each aperture 19 is generally square in cross-sectional shape and, likewise, vertical member 40 is generally square in cross-sectional shape. (It will be understood that if aperture 19 is differently shaped then vertical member 40 will be similarly complementary in shape.)

A portion of vertical member 40 of first leg 22 is received into one of apertures 19 and a portion of vertical member 40 of second leg 24 is received into the other of apertures 19. When vertical members 40 are thus engaged within apertures 19, the region of base 16 proximate the second end 16*f* thereof is able to be moved upwardly or downwardly relative to upper surface 42*a* of horizontal member 42 and thereby relative to ground surface 44. This possible up-and-down motion is indicated by arrows "A" and "B" in FIG. 5. This arrangement makes it possible for a user to raise or lower base 16 to accommodate different heights "H" of concrete pad 12 relative to ground surface 44. The user will raise or lower second end 16*f* of base 16 so that the second end 16*f* is generally equal to the height "H" of pad 12.

Each of first and second support legs 18, 20 include a locking mechanism which secures the leg to base 12 in a preselected and set position. One type of possible locking mechanism is illustrated in the attached figures and comprises a column of holes 46 in vertical members 40 and a cooperating pin 48. Vertical members 40 may be hollow tubes that have first and second side walls which are opposed to each other. The plurality of holes 46 is defined in the first and second side walls of each vertical member 40 and pairs of these holes 46 in the opposed side walls are horizontally aligned with each other. The pairs of aligned holes 46 are spaced vertically from each other and form a column of holes 46 on each of the first and second side walls of vertical members 40. When it is desired to set the height of platform 10 relative to ground surface 44 in order to align upper surface 16*a* of base 16 with upper surface 12*a* of concrete pad 12, the user will align one pair of holes 46 in one of the first and second legs 22, 24 with a hole 38 in the associated one of the first and second arms 18, 20 on base A pin 48 is inserted through these aligned holes 38, 46 to lock base 16 and first and second side arms 18, 20 in a particular set position relative to each other. The other of the first and second support legs 22, 24 is similarly and independently locked to base 16.

Each of the locking mechanisms is individually operable and so the length of the support legs 22, 24 which extends below lower surface 16*b* of base 16 may be individually set. The lengths of the two supports legs 22, 24 extending from lower surface 16*b* can therefore be different in order to accommodate differences in the elevation of the ground surface 44 between the horizontal members of first and second legs 22, 24. The user will select and lock each support leg 22, 24 in a set position relative to base 16 and ground surface 44 so that upper surface 16*a* of base is level and is horizontally aligned with upper surface 12*a* of concrete pad 12.

FIGS. 1 and 5 illustrate that a stop 26 is secured to second end 16*f* of base 16. Stop 26 may be an L-shaped member having a vertical member 26*a* and a horizontal member 26*b* that are oriented at right angles to each other. Stop 26 is positioned on second end 16*f* of base 16 such that horizontal member 26*b* is adjacent bottom surface 16*b* of base 16 and vertical member 26*a* is disposed immediately adjacent second end 16*f* of base 16. Vertical member 26*a* forms an upstanding lip relative to upper surface 16*a* of base 16. The interior surfaces of first and second arms 18, 20 also form an upstanding lip relative to upper surface 16*a* of base 16. The lips formed by stop 26 and first and second arms 18, 20 aid in preventing a concrete cutter 14 from rolling off upper surface 16*a* of base 16.

Figure 6:
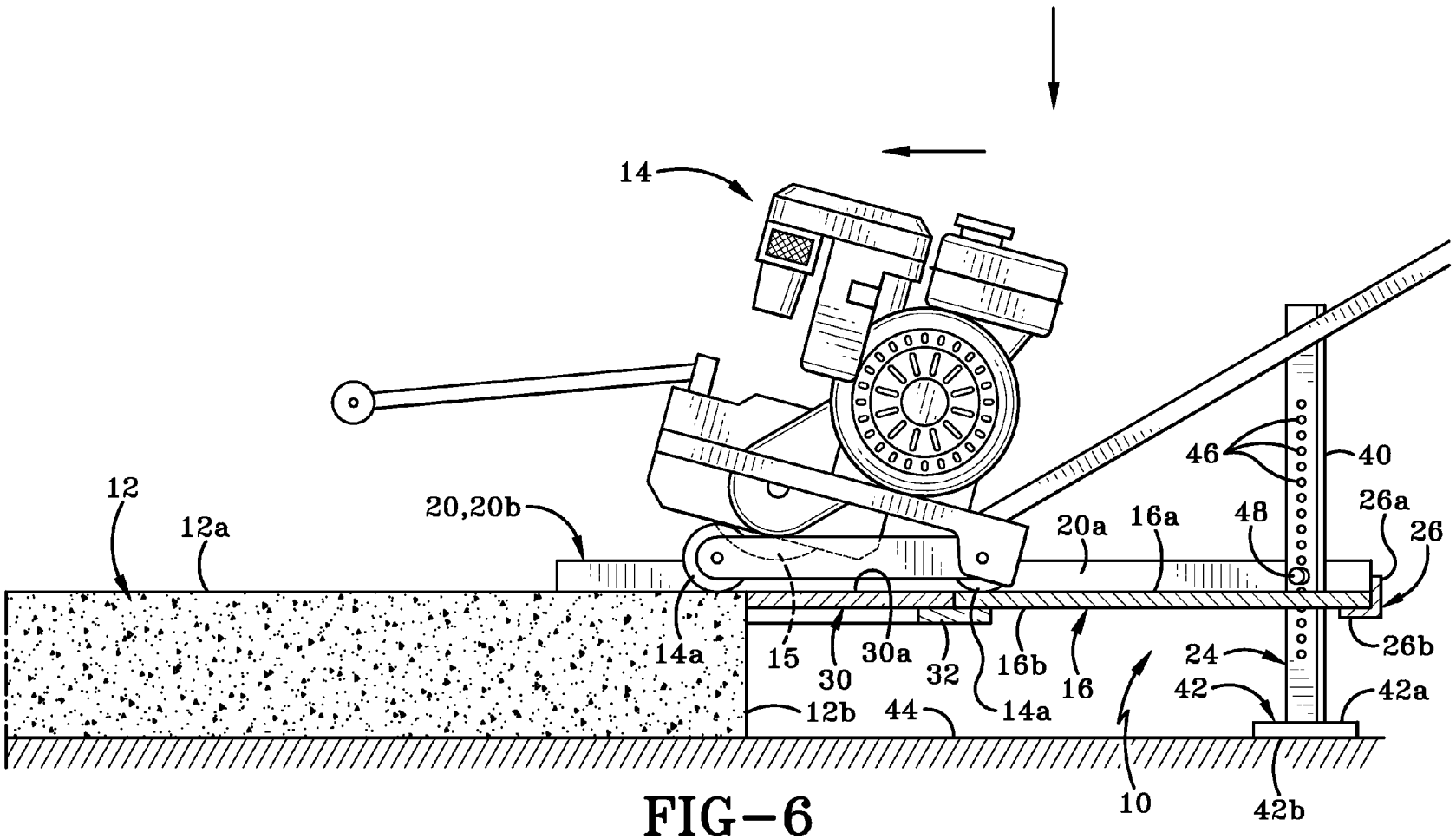
FIG. 6 is a partial cross-sectional side view of the cutting platform showing the platform supporting a concrete cutter; where the concrete cutter is in an initial position where it is not yet being used to cut into the concrete.
Figure 7:
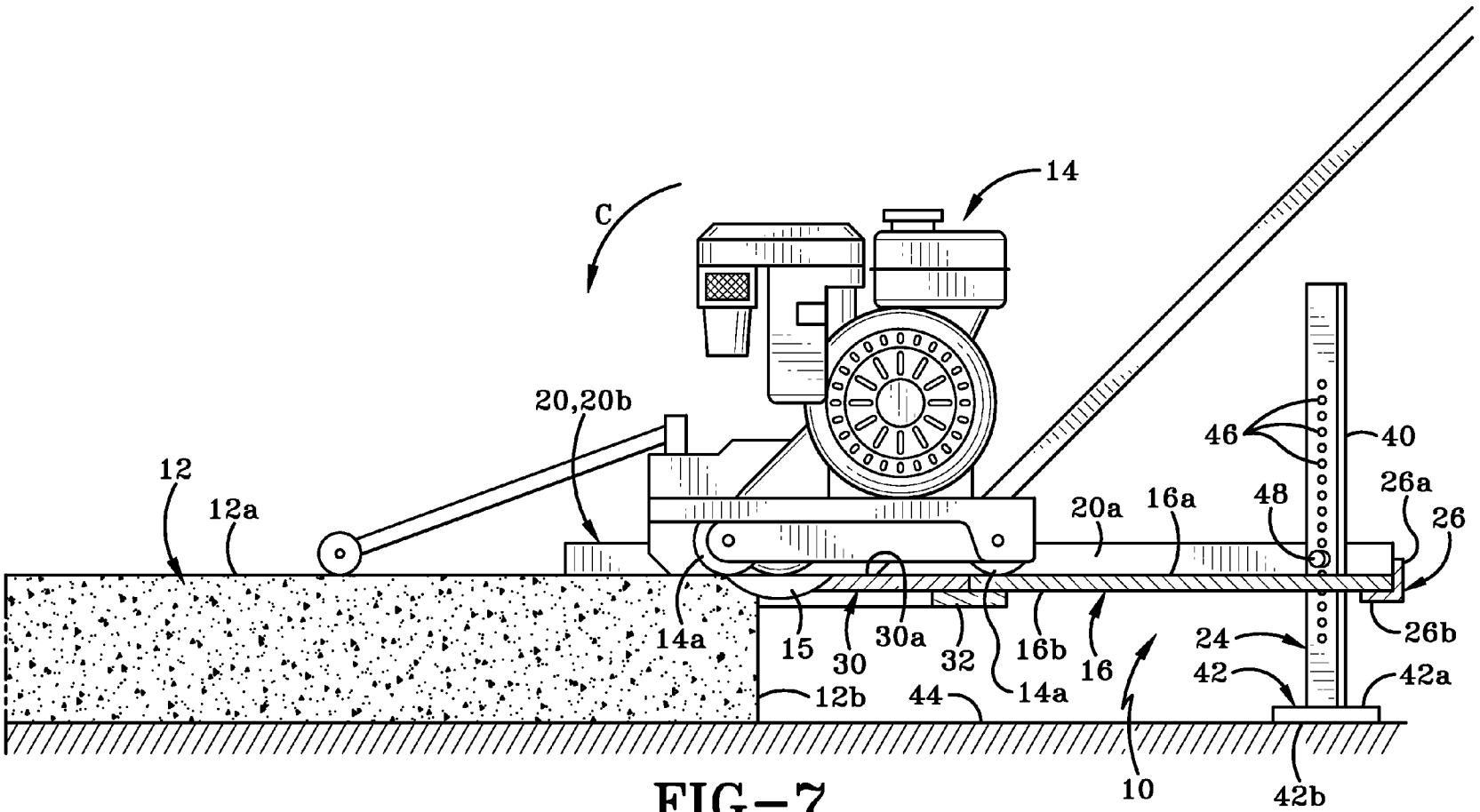
FIG. 7 is a partial cross-sectional side view of the platform and the concrete cutter with the cutter saw blade in a first position at an outer edge of the concrete pad and ready for use.

FIG. 6 shows platform 10 supporting concrete cutter 14 in a position adjacent concrete pad. Second sections 18*b*, 20*b* of first and second arms 18, 20 are placed onto the upper surface 12*a* of concrete pad 12. Platform 10 is pushed inwardly toward side surface 12*b* of concrete pad 12 and this moves second section 17*b* of base 16 into a position where second section 17*b* is adjacent to or abutting side surface 12*b* of pad 12. Substantially the entire length of second section 17*b* is oriented substantially parallel to side surface 12*b*. The position of base 16 relative to upper surface 12*a* of concrete pad 12 is then assessed. If it is found that base 16 is positioned a distance vertically downwardly relative to upper surface 12*a*, then pins 48 are removed from the pairs of aligned holes 46 in first and second legs 22, 24. Once this is done, base 16 is free to move upwardly relative to horizontal members 42 of first and second legs 22, 24. This upward movement is accomplished by the user lifting second end 16*f* of base 16 upwardly and thereby effectively sliding a length of the first and second legs 22, 24 downwardly through apertures 19 in base. This length of the first and second legs extends downwardly from lower surface 16*b* of base 16. The length is adjustable so that base 16 may be leveled with different heights of concrete pad 10. When upper surface 16*a* of base 16 is horizontally aligned, i.e. laying in the same plane, as upper surface 12*a* of concrete pad 12, then pins 48 are inserted through the appropriate aligned holes 38, 46 as described above in order to lock base 16 in that position.

Similarly, if it is found that upper surface 16*a* of base 16 is positioned a distance vertically above upper surface 12*a* of pad 12, then pins 48 are removed from holes 16, and second end 16*f* of base 16 is moved downwardly so that a length of first and second legs 22, 24 slides effectively upwardly through apertures 19. There is thus less of the length of first and second legs 22, 24 extending downwardly from lower surface 16*b* of base 16 than before. When upper surfaces 16*a*, 12*a* are horizontally aligned, pins 48 are reinserted through aligned holes 38, 46, and base 16 is then ready for concrete cutter 14 to be placed thereon.

FIG. 6 shows concrete cutter 14 placed onto the upper surface 16*a* of base 16 and then lowered into a position ready for actuation. Cutter 14 is positioned so that wheels 14*a* thereof rest on upper surface 16*a* of base. Initially the saw blade 15 and upper components of cutter 14 are angled relative to upper surface 16*a* of base 16. In this orientation, blade 15 of cutter 14 is positioned a distance above upper surface 16*a* of base 16 and particularly above upper surface 30*a* of insert 30. It should be noted that upper surface 30*a* of insert 30 lies in substantially the same plane as upper surface 16*a* of base 16.

Figure 8:
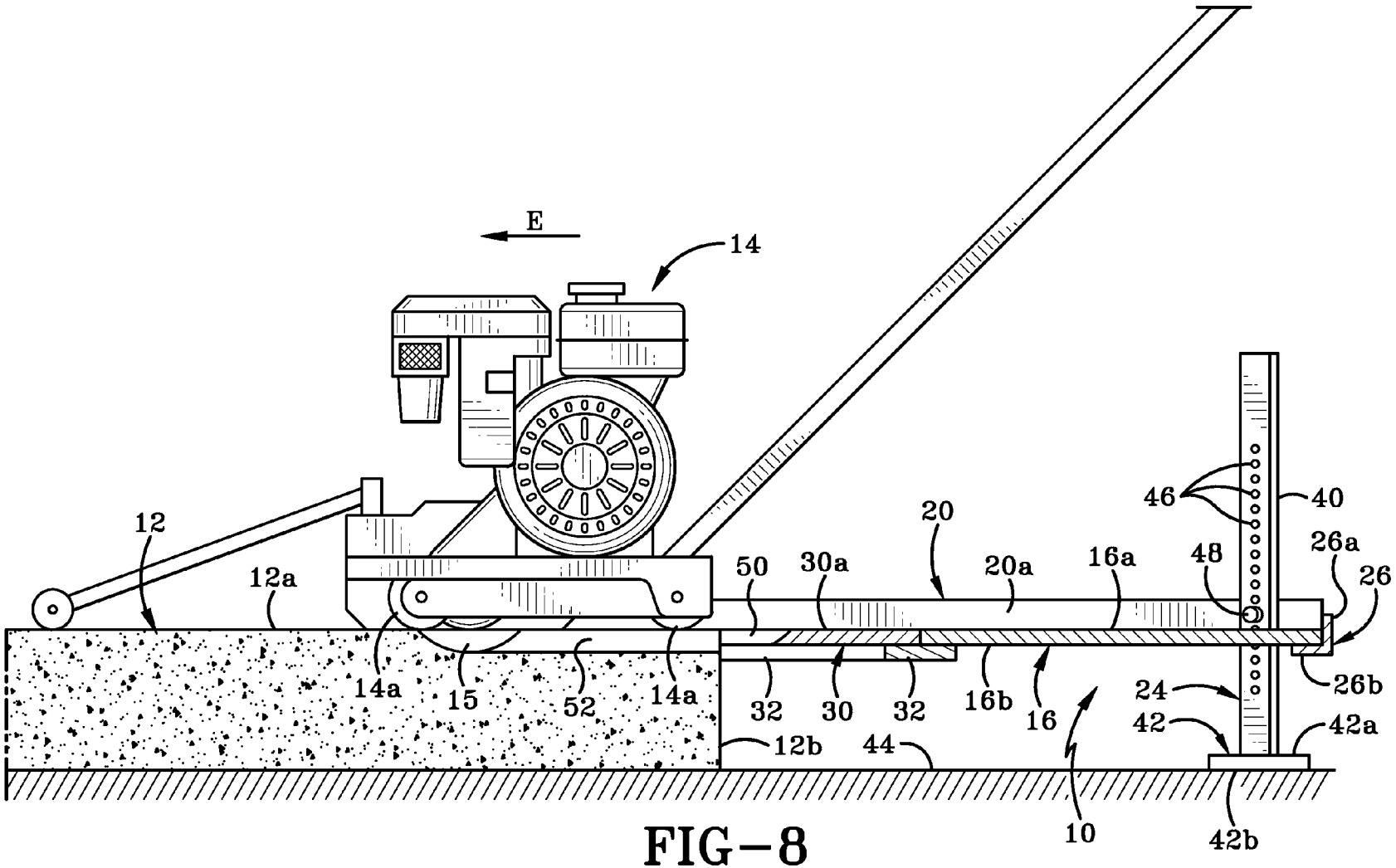
FIG. 8 is a partial cross-sectional side view of the platform supporting the concrete cutter in a second position where the blade has cut a distance through an insert in to the cutting platform and a further distance into the pad.
Figure 9:
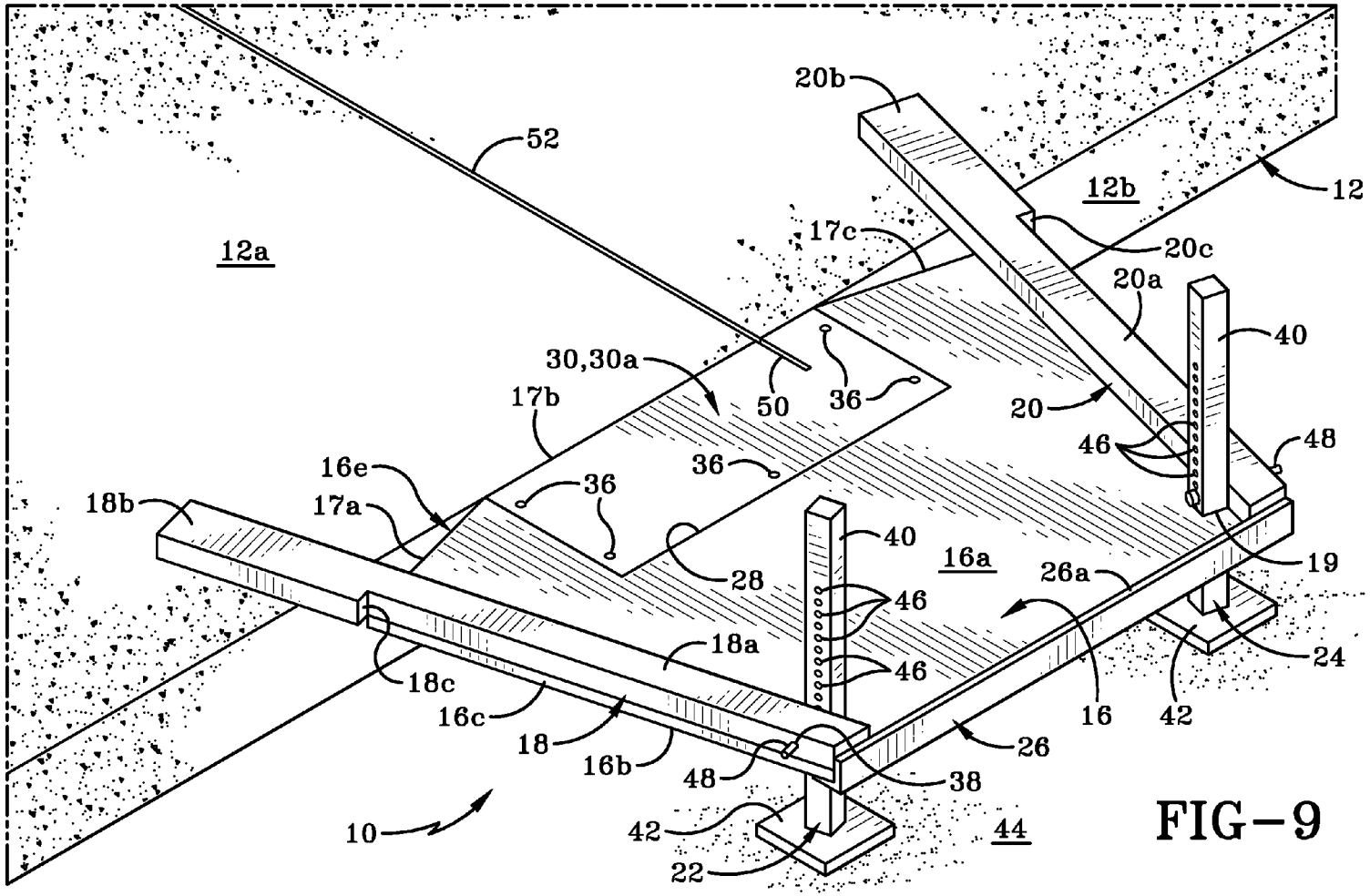
FIG. 9 is a rear perspective view of the platform with the concrete cutter removed therefrom and showing the expansion joint cut into the pad.
Figure 10:
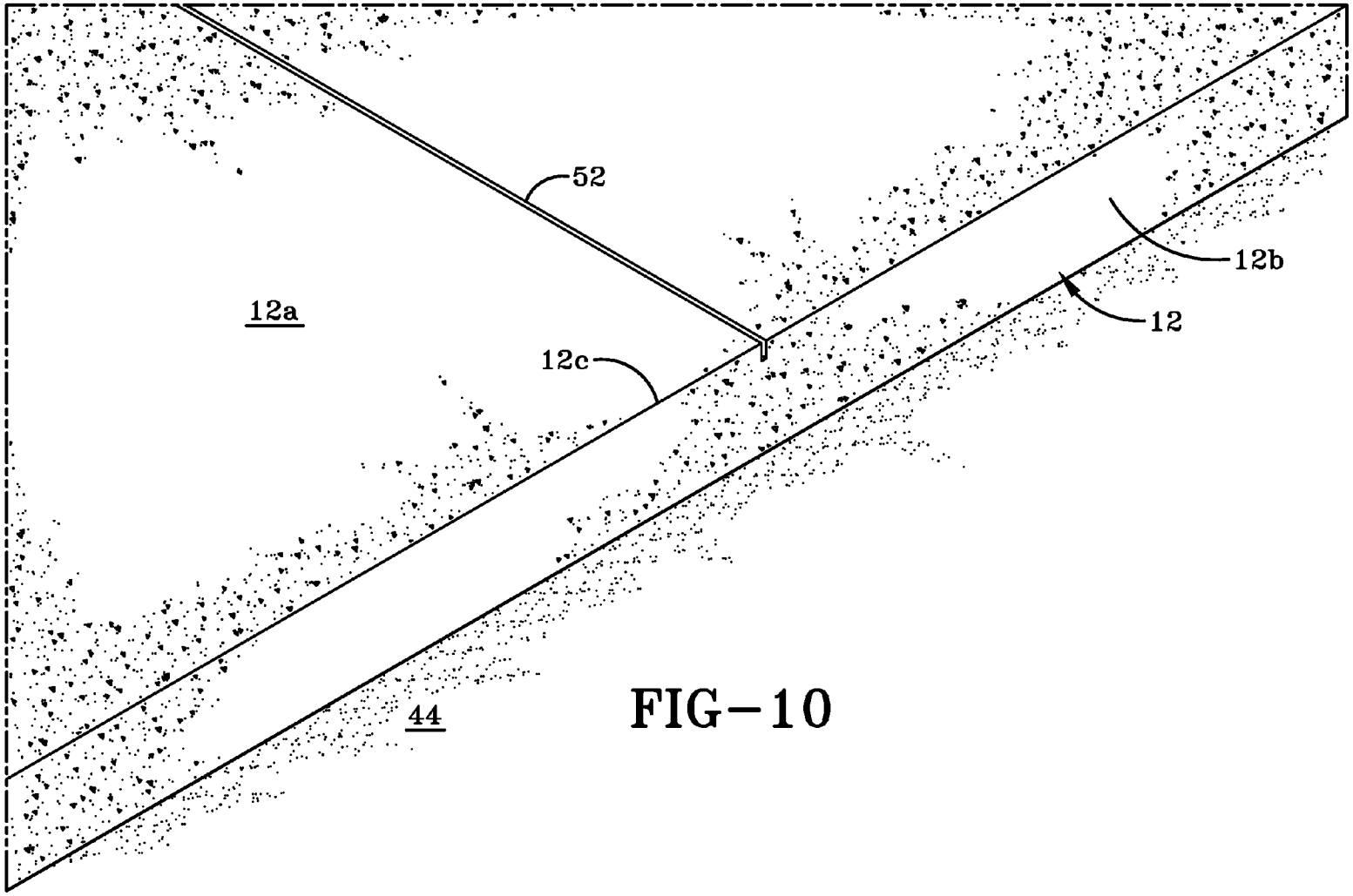
FIG. 10 is a rear perspective view of the pad with the expansion joint cut therein and the platform removed therefrom.

When the user is ready to cut an expansion joint into concrete pad 12, cutter 14 is actuated so that saw blade 15 begins to rotate. The upper portion of the body of the cutter 14, including saw blade 15 is then lowered in the direction of arrow "C" (FIG. 7) to bring the rotating saw blade 15 into contact with upper surface 30*a* of insert 30. As the rotating saw blade 15 contacts upper surface 30*a* of insert 30, the blade begins to cut a groove into the same. (If insert 30 is omitted, then the rotating blade 15 will contact and cut into upper surface 16*a* of base 16. The user then pushes concrete cutter 14 in the direction of arrow "E" (FIG. 8). This movement causes wheels 14*a* to roll along upper surface 16*a* of base (and if needful along upper surface 30*a* of insert 30) and onto upper surface 12*a* of pad. Groove 50 (FIG. 8) is thus cut into upper surface 30*a* of insert 30. When the rotating saw blade 15 reaches side surface 12*b* of concrete pad 12 it is already moving at a high rotational speed and thus begins to easily cut into side surface 12*b* and upper surface 12*a* of concrete pad 12. Continued movement of cutter 14 in the direction of arrow "E" while blade 15 is rotating (FIG. 8) will result in an expansion joint 52 being cut into concrete pad 12. Because blade 15 is already rotating at a high speed, when the blade 15 encounters side surface 12*b* and upper surface 12*a* of pad 12, the cut the blade 15 makes is a clean cut, i.e., there is less of a tendency for chunks of concrete to be chopped out of pad 12 than if platform 10 was not utilized. Concrete cutter 14 will continue to cut expansion joint 52 in pad 10 as movement of the cutter 14 in the direction of arrow "E" continues. When expansion joint 52 is of a suitable and desired length, the rotation of saw blade 15 is shut off and then concrete cutter 14 is removed from upper surface 12*a* of pad 12. FIG. 9 shows platform 10 with cutter 14 removed and showing the initial groove 50 cut into insert 30 and the expansion joint 52 cut into concrete pad 12. FIG. 10 shows pad 12 after platform 10 has been removed therefrom. As is evident from FIGS. 9 and 10, a clean expansion joint 52 has been cut into pad 12 and the edge 12*c* of pad is undamaged.

It should be noted that the angled first and third sections 17*a*, 17*c* of first end 16*e* enable cutting platform 10 to engage a variety of differently shaped concrete pads. Platform 10 may be differently oriented relative to side surface 12*b* of concrete pad 12 simply by bringing one or the other of the first and third sections 17*a*, 17*c* into abutting contact with side surface 12*b* instead of utilizing second section 17*b* for this purpose. Cutter 14 may then be rolled off base 16 at an angle if that is needful. It will further be understood that first end 16*e* of platform 16 could be custom fabricated to include contours that are complementary to differently contoured concrete pad side surfaces and upper edges other than those (12*b*, 12*c*) illustrated herein.

It will further be understood that other modifications may be made to cutting platform 10. For example, first and second arms 18, 20 may be extendible in length. Still further, additional support legs of a similar or different configuration to that illustrated herein for first and second support legs 22, 24 could be utilized. These additional support legs could simply fold out from under lower surface 16*b* of base 16 and be adjustable in length to accommodate different height concrete pads 12. The additional support legs could be positioned at locations other than adjacent the rear and the first and second sides 16*c*, 16*d* of base 16. The additional support legs could be placed in other locations which will cause the legs to provide adequate support to base 16 for supporting concrete cutter 14. Still further, apertures 19 and first and second support legs 22, 24 could be placed in locations other than those shown herein.

The method of cutting an elevated concrete pad 12 comprises positioning a cutting platform 10 adjacent a side wall 12*b* of concrete pad 12; adjusting the height of cutting platform 10 so that an upper surface 16*a* of cutting platform 10 is substantially horizontally aligned with an upper surface 12*a* of concrete pad 12; positioning a concrete cutter 14 on upper surface 16*a* of cutting platform 10 so that a saw blade 15 on concrete cutter 14 is disposed adjacent a region of the upper surface of the cutting platform; actuating concrete cutter 14 so that saw blade 15 rotates and begins to cut an expansion joint into the region of the upper surface 16*a* of the cutting platform; advancing concrete cutter 14 with the rotating blade 15 across upper surface 16*a* of cutting platform 10 and toward side wall 12*b* of concrete pad 12; cutting into an upper edge 12*c* of side wall 12*b* of concrete pad 12 with the rotating saw blade 15; advancing concrete cutter 14 with the rotating saw blade 15 from upper surface 16*a* of cutting platform 10 and onto upper surface 12*a* of concrete pad 12; and cutting into upper surface 12*a* of concrete pad 12 with the rotating saw blade 15 to form an expansion joint in upper surface 12*a*. The step of positioning the cutting platform 10 further includes placing at least one arm 18 or 20 extending outwardly from cutting platform 10 onto upper surface 12*a* of concrete pad 12. The positioning of cutting platform 10 further includes abutting a first side edge 16*c* of cutting platform 10 against side wall 12*b* of concrete pad 12. Additionally, a first support leg 22 and a second support leg 24 of cutting platform 10 are placed on a ground surface a distance away from side wall 12*b* of concrete pad 12.

As indicated above, the method includes adjusting the height of cutting platform 10. This is accomplished by raising or lowering an end 16*d* of cutting platform 10 which is located a distance away from side wall 12*b* of concrete pad 12 to a height that is substantially equal to a height of upper surface 12*a* of concrete pad 12. The raising or lowering of the end 16*d* of cutting platform 10 includes the step of adjusting the length of one or both of a first and second support leg 22, 24 which extend outwardly from a lower surface 16*b* of cutting platform 10. The adjustment in the length of first and second support legs 22, 24 requires the user to disengage a locking mechanism 46/48 on one or both of first and second support legs 22, 24; move a length of one or both of first and second support legs 22, 24 through an associated aperture 19 in cutting platform 10 in one of a first direction or a second direction; and then re-engage the locking mechanism 46/48. The step of disengaging the locking mechanism 46/48 includes withdrawing a pin 48 from a first hole 46*a* defined in the respective one of first and second support legs 22, 24; and the step of re-engaging the locking mechanism 46/48 includes inserting the pin 48 into a second hole 46*b* defined in the respective one of the first and second support legs 22, 24; wherein the second hole 46*b* is vertically spaced from first hole 46*a*.

The method further comprises the step of engaging a cuttable insert 30 into a recessed region 28 defined in first end 16*e* of the cutting platform 10 prior to the step of positioning concrete cutter 14 on upper surface 16*a* of the cutting platform 10. The step of actuating concrete cutter 14 so that saw blade 15 rotates and begins to cut into the region of upper surface 16*a* of the cutting platform 10 further comprises the step of positioning concrete cutter 14 on cutting platform 10 so that saw blade 15 will cut into the cuttable insert 30 upon actuation.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

The invention claimed is:

1. A cutting platform for supporting a concrete cutter adjacent a concrete pad; said cutting platform comprising:

a base having an upper surface and a lower surface;

a recess defined in the base and extending between the upper and lower surfaces;

a removable insert engageable in the recess; wherein the insert is fabricated from a material that is cuttable by a saw blade of a concrete cutter; and wherein the base is adapted to receive the concrete cutter on the upper surface thereof;

at least a first support leg extending downwardly and outwardly from a lower surface of the base; and at least one arm provided on the base, at least part of the at least one arm extending outwardly and forwardly from a first end of the base and being adapted to rest on an upper surface of the concrete pad.

2. The cutting platform as defined in claim 1, wherein the recess originates in the first end of the base and extends inwardly for a distance toward a second end thereof; and wherein the insert is complementary to the recess.

3. The cutting platform as defined in claim 1, wherein the insert is comprised of wood.

4. The cutting platform as defined in claim 1, wherein the base includes a second end that is spaced a distance from the first end; and wherein the at least the first leg is located adjacent the second end of the base and extends downwardly therefrom; and wherein the first end of the base is free of legs.

5. The cutting platform as defined in claim 1, wherein the base includes a first side and a second side which extend between the first and second ends; and wherein the first support leg is located adjacent the first side; and a second support leg is located adjacent the second side.

6. The cutting platform as defined in claim 1, wherein the first end of the base is of a first width as measured between a first side and a second side of the base; and a second end of the base is of a second width as measured between the first and second sides; and the first width is greater than the second width.

7. The cutting platform as defined in claim 1, wherein a pair of arms extends outwardly and forwardly from the first end of the base, each of the pair of arms being adapted to at least partially rest on an upper surface of the concrete pad; and wherein a first arm of the pair of arms is provided adjacent a first side of the base and a second arm of the pair of arms is provided adjacent a second side of the base.

8. The cutting platform as defined in claim 7, wherein each of the first and second arms includes a first section which extends upwardly from an upper surface of the base; and a second section that extends outwardly and forwardly from the first end of the base.

9. The cutting platform as defined in claim 1, wherein the base defines a first aperture in a location adjacent a second end of the base and defines a second aperture adjacent the second end and spaced from the first aperture, each of the first and second apertures extending from an upper surface of the base through to a lower surface thereof; and wherein a portion of the first support leg extends through the first aperture and a portion of the second support leg extends through the second aperture.

10. The cutting platform as defined in claim 9, wherein each of the first and second legs includes a horizontal member and a vertical member; wherein the horizontal member is adapted to rest upon a ground surface a distance from a side wall of the concrete pad to be cut; and the vertical member extends upwardly away from an upper surface of the horizontal member and a portion of the vertical member extends through the associated one of the first and second apertures in the base.

11. The cutting platform as defined in claim 10, further comprising a locking mechanism provided on each of the first and second support legs for selectively retaining the first and second support legs in a set position relative to the base.

12. The cutting platform as defined in claim 10, wherein the vertical member of each of the first and second support legs defines a plurality of vertically spaced-apart holes therein, each of said holes extending from a first side of the vertical member to a second side thereof; and a pin is selectively engageable in a selected one of the holes so as to retain the associated one of the first and second support legs in a set position relative to the base.

13. The cutting platform as defined in claim 1, wherein at least the first support leg has a length that extends outwardly and downwardly from a lower surface of the base; and wherein the length is adjustable.

14. A method of cutting an elevated concrete pad comprising:

positioning a cutting platform adjacent a side wall of the concrete pad;

adjusting the height of the cutting platform so that an upper surface of the cutting platform is substantially horizontally aligned with an upper surface of the concrete pad;

positioning a concrete cutter on the upper surface of the cutting platform so that a saw blade on the concrete cutter is disposed adjacent a region of the upper surface of the cutting platform;

actuating the concrete cutter so that the saw blade rotates and begins to cut into the region of the upper surface of the cutting platform;

advancing the concrete cutter with the rotating blade across the upper surface of the cutting platform and toward the side wall of the concrete pad;

cutting into an upper edge of the side wall of the concrete pad with the rotating saw blade; and advancing the concrete cutter with the rotating saw blade from the upper surface of the cutting platform and onto the upper surface of the concrete pad; and cutting into the upper surface of the concrete pad with the rotating saw blade.

15. The method as defined in claim 14, wherein the step of positioning the cutting platform includes:

placing at least one arm extending outwardly from the upper surface of the cutting platform onto the upper surface of the concrete pad.

16. The method as defined in claim 14, wherein the step of positioning the cutting platform includes:

abutting a first side edge of the cutting platform against the side wall of the concrete pad.

17. The method as defined in claim 14, wherein the step of positioning the cutting platform includes:

placing a first support leg and a second support leg of the cutting platform on a ground surface a distance away from the side wall of the concrete pad.

18. The method as defined in claim 14, wherein the step of adjusting the height of the cutting platform includes:

raising or lowering an end of the cutting platform that is located a distance away from the side wall of the concrete pad to a height that is substantially equal to a height of the upper surface of the concrete pad.

19. The method as defined in claim 18, further comprising the step of:

adjusting the length of one or both of a first and second support leg which extend outwardly from a lower surface of the cutting platform.

20. The method as defined in claim 19, wherein the step of adjusting the length of the first and second support legs includes:

disengaging a locking mechanism on one or both of the first and second support legs;

moving a length of each of the first and second support legs through an associated aperture in cutting platform in one of a first direction or a second direction; and re-engaging the locking mechanism.

21. The method as defined in claim 20, wherein the step of disengaging the locking mechanism includes withdrawing a pin from a first hole defined in the respective one of the first and second support legs; and the step of re-engaging the locking mechanism includes inserting the pin into a second hole defined in the respective one of the first and second support legs; wherein the second hole is vertically spaced from the first hole.

22. The method as defined in claim 14, further comprising the step of engaging a cuttable insert into a recessed region defined in a first end of the cutting platform prior to the step of positioning a concrete cutter on the upper surface of the cutting platform.

23. The method as defined in claim 22, wherein the step of actuating the concrete cutter so that the saw blade rotates and begins to cut into the region of the upper surface of the cutting platform further comprises the step of positioning the concrete cutter on the cutting platform so that the saw blade will cut into the cuttable insert upon actuation.

24. The cutting platform in accordance with claim 7, wherein each of the first and second arms does not extend below a lower surface of the base.

25. A cutting platform and a concrete cutter in combination; wherein the cutting platform comprises:

a base having an upper surface, a lower surface, a first end and a second end;

a recess defined in the base, said recess extending between the upper and lower surfaces of the base;

a removable insert engageable in the recess; wherein the insert is fabricated from a material that is cuttable;

at least one support leg extending downwardly and outwardly from a lower surface of the base; and at least one arm provided on the base, wherein part of the at least one arm extends outwardly and forwardly from the first end of the base and is adapted to rest on an upper surface of a concrete pad; and wherein the concrete cutter comprises:

a housing that is positionable on the upper surface of the cutting platform's base; and a rotatable saw blade mounted on the housing; said saw blade being oriented so as to cut through the insert and subsequently into a region of the concrete pad positioned adjacent the insert.

* * * * *